US010046583B2

(12) United States Patent
Endo et al.

(10) Patent No.: US 10,046,583 B2
(45) Date of Patent: Aug. 14, 2018

(54) ROLL PAPER FOR PRINTING, AND INKJET PRINTER

(71) Applicant: Seiko Epson Corporation, Toyko (JP)

(72) Inventors: Hiroyuki Endo, Shiojiri (JP); Yusuke Kanno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 14/778,810

(22) PCT Filed: Mar. 25, 2014

(86) PCT No.: PCT/JP2014/001701
§ 371 (c)(1),
(2) Date: Sep. 21, 2015

(87) PCT Pub. No.: WO2014/156122
PCT Pub. Date: Oct. 2, 2014

(65) Prior Publication Data

US 2016/0046139 A1 Feb. 18, 2016

(30) Foreign Application Priority Data

Mar. 28, 2013 (JP) ..... 2013-068265

(51) Int. Cl.

| | |
|---|---|
| ***B41J 11/00*** | (2006.01) |
| ***B41M 5/50*** | (2006.01) |
| ***G09F 3/02*** | (2006.01) |
| ***B41J 3/407*** | (2006.01) |
| ***G09F 3/10*** | (2006.01) |

(52) U.S. Cl.
CPC ..... *B41M 5/508* (2013.01); *B41J 3/4075* (2013.01); *B41J 11/009* (2013.01); *B41J 11/0085* (2013.01); *G09F 3/02* (2013.01); *G09F 3/10* (2013.01)

(58) Field of Classification Search
CPC ..... B41J 11/0085; B41J 11/009
See application file for complete search history.

(56) References Cited

U.S. PATENT DOCUMENTS

2007/0146457 A1* 6/2007 Kito ..... B41J 11/0035 347/101
2009/0244246 A1* 10/2009 Nakamaki ..... B41J 11/0085 347/104

FOREIGN PATENT DOCUMENTS

| | | |
|---|---|---|
| JP | 2007-152785 A | 6/2007 |
| JP | 2007-248492 A | 9/2007 |
| JP | 3140463 U | 3/2008 |
| JP | 2012-118187 A | 6/2012 |

* cited by examiner

*Primary Examiner* — Julian Huffman
(74) *Attorney, Agent, or Firm* — Foley & Lardner LLP

(57) ABSTRACT

Roll paper for printing maintains high bending resistance at the perforations without impairing the ease of separation at the perforation. The paper has perforations 15A, 25A formed across the width of the paper at a specific interval lengthwise, and the perforation 15A, 25A have either a sawtooth shape or a wave shape. The roll paper also has a liner 11, and a plurality of labels 12 affixed by adhesive 13 at an even interval along the length of the liner 11. The perforation 15A, 25A are formed in the liner 11 between two adjacent labels 12.

5 Claims, 11 Drawing Sheets

ZIGZAG PERFORATION G

ROUND PERFORATION R

ZIGZAG PERFORATION G

ZIGZAG MICRO-PERFORATION GM

ROUND PERFORATION R

ROUND MICRO-PERFORATION RM

NORMAL PERFORATION N

NORMAL MICRO-PERFORATION NM

ROLL PAPER FOR PRINTING, AND INKJET PRINTER

TECHNICAL FIELD

The invention relates mainly to an inkjet printer and to roll paper for printing that is supplied for printing by an inkjet printer having a suction platen.

BACKGROUND

One example of this type of roll paper for printing is label paper, which has a set of labels with an adhesive backing affixed at a uniform interval to a separable liner (backing) as described in PTL 1.

The set of labels has a perforation formed in the liner between adjacent labels, and after printing labels, the individual labels can be separated at the perforation. Various types of perforations may be used, such as a continuous perforation and various combinations of cuts and dashes of different lengths, and the type of perforation is related to the type of label material (plain paper, thermal paper). The type of material used for the labels can therefore be known by observing the perforation after tearing off a label. Label paper of this type is commonly provided with the label paper wound into rolls for use in thermal printers.

CITATION LIST

Patent Literature

[PTL 1] JP-A-2012-118187

SUMMARY OF INVENTION

Technical Problem

With rolled label paper such as described above, the bending resistance in the area of a straight perforation is significantly lower than the bending resistance in the label part. As a result, when the label paper is rewound after printing for storage or shipping, for example, the label paper bends easily at the perforation and becomes very difficult to handle.

When printing such label paper with an inkjet printer having a suction platen, for example, the roll paper delivered from the paper roll may bend at the perforation and holding the label paper flat on the suction platen may not be possible. When little label paper remains on the roll, the label paper becomes tightly curled between one perforation and the next perforation in resistance to the suction force of the platen, and labels may curl and lift away from the platen. A desirable paper gap can therefore not be maintained, print quality deteriorates, and the part of the label paper that lifts away from the platen may interfere with the printhead.

Solution to Problem

An objective of the present invention is to provide an inkjet printer and roll paper for printing that can maintain high bending resistance at the perforation without impairing the ease of tearing the perforation.

Roll paper for printing according to the invention has a plurality of perforations formed across the width at a specific interval lengthwise, and each perforation has either a sawtooth shape or a wave shape.

Because the perforations running widthwise to the paper have a sawtooth or wave shaped pattern, the cut portions of the cuts and uncut parts forming the perforation are distributed without being aligned in the lengthwise direction. More specifically, the cuts are distributed throughout the entire formation area of the sawtooth or wave shaped perforations. As a result, high bending resistance can be maintained where the perforations are formed. The paper therefore does not bend at the perforation when the paper is unwound from the roll. However, because the cuts in the perforations form a continuous sawtooth or wave shaped pattern, the ease of tearing the perforation is not impaired.

Preferably, the roll paper for printing has a liner and a plurality of labels affixed by adhesive at an even interval along the length of the liner, and the perforations are formed in the liner between two adjacent labels.

With two-part label paper (roll paper) having plural labels adhesively affixed to a liner, the bending resistance in the areas where perforations are formed between labels is low, and the paper easily bends sharply at the perforation when the paper is unrolled.

Because this aspect of the invention can maintain high bending resistance in the area of the perforations (where the perforation is formed), the paper can be effectively prevented from bending sharply at the perforation when unwound from the roll.

Preferably, the ratio between the wave height W across the width and the peak-to-peak distance along the length of the perforation pattern is 1:1 to 1:5.

Thus comprised, high bending resistance can be maintained at the perforations without impairing the ease of tearing the paper at the perforations.

Further preferably, the ratio between the length of the cut portion and the length of the uncut portion in the perforation pattern is approximately 1:1.

The ratio between the length of the cut portion and the length of the uncut portion is approximately 2:1 in most common perforation patterns. By making this ratio 1:1, higher bending resistance can be maintained.

Further preferably, the widthwise ends of the perforations continue straight along the width.

Because the part where the perforation starts to tear is straight, the ease of tearing the perforation can be desirably maintained.

Further preferably, the roll paper preferably receives suction force (a force of attraction) from a platen opposite the printhead when printing in an inkjet recording device.

Thus comprised, because bending at the perforation is suppressed, roll paper for printing that enables maintaining a desirable paper gap and is suitable for printing using an inkjet recording device can be provided.

An inkjet recording device according to the invention prints on specialized roll paper that is the roll paper described above, and common roll paper having straight perforations formed across the width, selectively loaded as the recording medium, and includes: a printhead that selectively ejects ink and prints on the specialized roll paper and the common roll paper; a suction platen that is disposed opposite the printhead and applies suction force to the conveyed specialized roll paper and common roll paper; a suction fan that communicates with the suction platen; and a control unit that controls driving the suction fan based on a control table setting a different suction force for the specialized roll paper and the common roll paper.

Thus comprised, the suction force of the suction platen can be changed through the suction fan based on whether the loaded recording medium is specialized roll paper or common roll paper. As a result, the appropriate suction force can be applied to specialized roll paper and common roll paper, which have different bending resistance at the perforations. More specifically, a low suction force may be applied to specialized roll paper, and a stronger suction force may be applied to common roll paper. As a result, high print quality can be maintained with both specialized roll paper and common roll paper while reducing power consumption and reducing noise.

Further preferably, the inkjet recording device according to the invention has a reading unit that reads the type of specialized roll paper and common roll paper, information about the thickness or material of the specialized roll paper and the common roll paper is included for each type, and the control unit controls driving the suction fan according to the thickness or material information. Thus comprised, appropriate suction force can be applied based on the information about the thickness or material of the loaded recording medium.

DESCRIPTION OF EMBODIMENTS

Two-part label paper as an example of roll paper for printing according to the invention, and an inkjet printer that uses the label paper, are described below with reference to the accompanying figures. This inkjet printer prints primarily to roll paper (recording media), and has a suction platen that applies suction to the conveyed roll paper to maintain a desirable paper gap when printing. The roll paper that is used may be two-part label paper with a specialized perforation (referred to below as "specialized roll paper") according to the invention, two-part label paper with a conventional perforation (referred to below as "common label paper"), or plain roll paper without perforations.

The specialized roll paper is described below with comparison to common roll paper while also describing an inkjet printer that prints to specialized roll paper and common roll paper.

Figure 1:
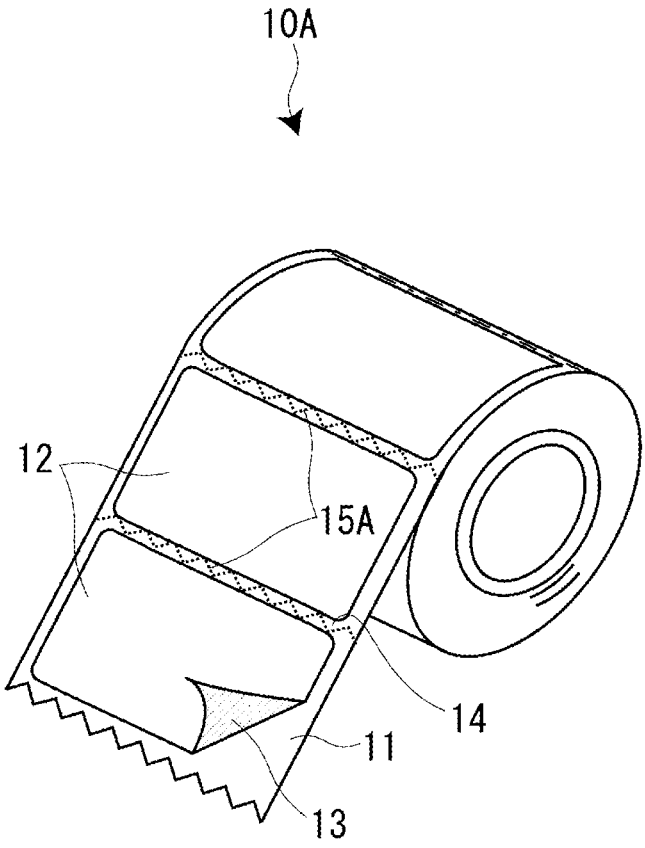
FIG. 1 is an external oblique view of roll paper for printing (specialized roll paper) according to the first embodiment of the invention.

FIG. 1 is an external oblique view of specialized roll paper, which is a type of two-part label paper. As shown in the figure, the specialized roll paper 10A includes a liner 11 (backing) as a continuous web, and multiple labels 12 that are adhesively affixed at a regular interval along the length of the liner 11 by an adhesive 13. The plural labels 12 are formed by die-cutting (kiss cutting) a continuous web with an adhesive 13 coating. The specialized roll paper 10A in this embodiment of the invention has a space 14 of approximately 3 mm (less than or equal to 6 mm) between each two adjacent labels 12, and the perforation 15A is formed in the center of this space 14. More specifically, perforations 15A are formed in the liner 11 crosswise between adjacent labels 12 according to the pitch of the plural labels 12.

Figure 2A:
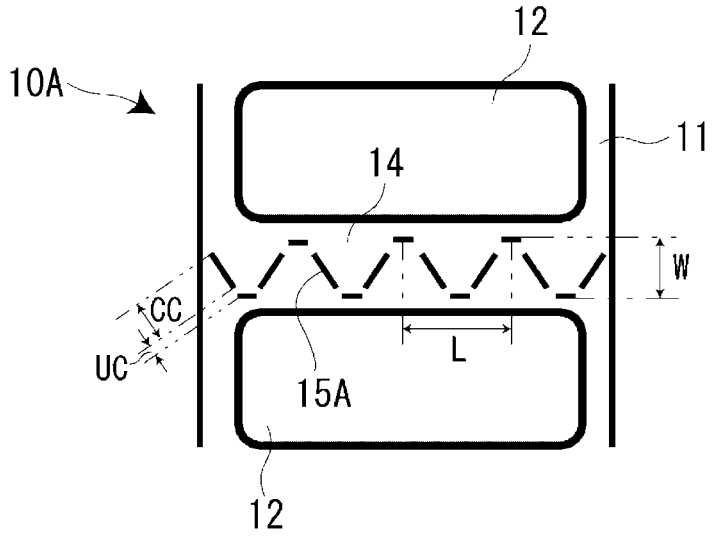
FIG. 2 is a plan view in part of roll paper for printing (specialized roll paper) according to the first embodiment of the invention.
Figure 2B:
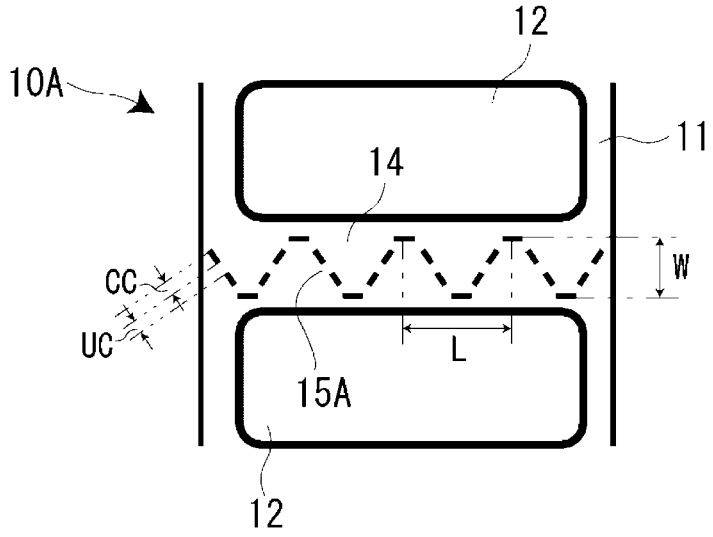

As shown in FIG. 1 and FIG. 2, the perforations 15A are formed in a sawtooth pattern across the width of (crosswise to) the liner 11. More specifically, the space 14 in the liner 11 between labels 12 is the perforation formation area, and the perforations 15A are formed in a sawtooth pattern undulating through the full width of the formation area. For example, this sawtooth pattern may be shaped with a series of flat peaks so that the tip of each tooth of the sawtooth pattern is not sharp. The ratio between the wave height W across the width of the perforation 15A wave and the peak-to-peak distance L along the length of the perforation 15A is preferably from 1:1 to 1:5, and in this embodiment of the invention is 1:2. The ratio between the length of the cut portion CC and the length of the uncut portion UC in each perforation 15A is preferably approximately 2:1 or approximately 1:1.

The specialized roll paper 10A shown in FIG. 2 (*a*) has a perforation 15A with a 1:2 ratio between the wave height W and the peak-to-peak distance L, and a 2:1 ratio between the cut portion CC and the uncut portion UC. Below, this perforation 15A is referred to as a zigzag perforation G.

The specialized roll paper 10A shown in FIG. 2 (*b*) has a perforation 15A with a 1:2 ratio between the wave height W and the peak-to-peak distance L, and a 1:1 ratio between the cut portion CC and the uncut portion UC. Below, this perforation 15A is referred to as a zigzag micro-perforation GM.

Figure 3A:
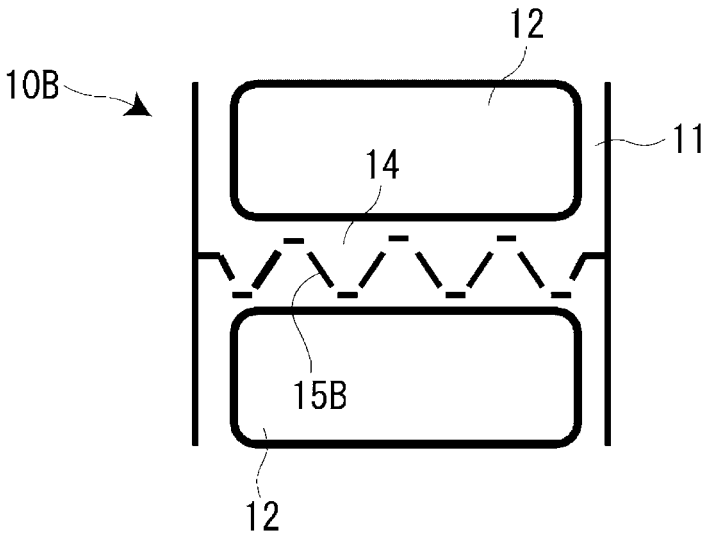
FIG. 3 is a plan view in part of roll paper for printing (specialized roll paper) according to another example of the first embodiment of the invention.
Figure 3B:
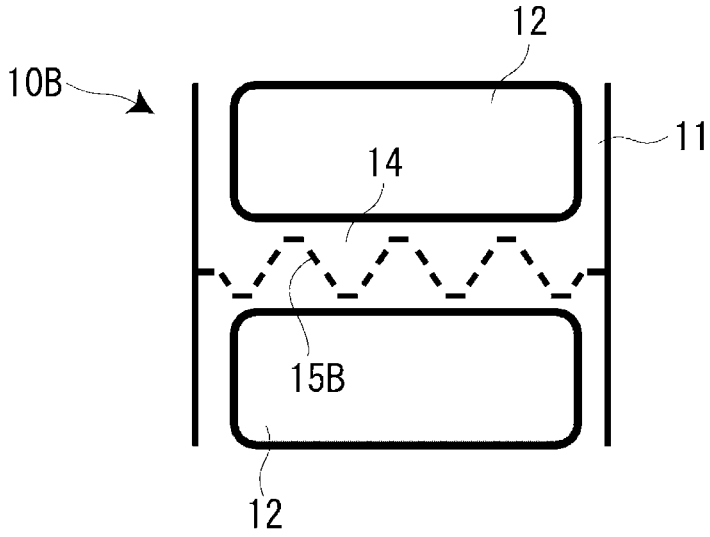

FIG. 3 illustrates specialized roll paper 10B according to another example of embodiment 1. The perforation 15B in the specialized roll paper 10B according to this example has the same basic sawtooth shape as in the first embodiment while making tearing the perforation easier.

FIG. 3 (*a*) is a variation of the zigzag perforation G described above with the opposite ends of the zigzag continuing straight widthwise to the liner 11. More specifically, the ratio between the cut portion CC and the uncut portion UC of the perforation 15B in this variation of the zigzag perforation G is 2:1, and the perforation 15B combines a straight cut, a sawtooth pattern, and another straight cut across the width of the specialized roll paper 10B.

FIG. 3 (*b*) is a variation of the zigzag micro-perforation GM described above with the opposite ends of the zigzag continuing straight widthwise to the liner 11 as described above. More specifically, the ratio between the cut portion CC and the uncut portion UC of the perforation 15B in this variation of the zigzag micro-perforation GM is 1:1, and the perforation 15B combines a straight cut, a sawtooth pattern, and another straight cut across the width of the specialized roll paper 10B.

Because the perforation 15A, 15B has a sawtooth shape in the specialized roll paper 10A, 10B according to the first embodiment of the invention, the cuts CC in the perforations 15A, 15B are distributed without aligning in the lengthwise direction of the specialized roll paper 10A, 10B. More specifically, the cuts CC are distributed throughout the formation area (space 14) of the sawtooth shaped perforations 15A, 15B. As a result, high bending resistance can be maintained in the formation area of the perforations 15A, 15B without reducing the ease of tearing the perforations 15A, 15B. Therefore, excessive uplift from the suction platen 56 can be desirably prevented as described in detail below without the label paper bending at the perforations 15A, 15B (see FIG. 9 (*b*)) when the label paper is delivered from a wound roll.

Figure 4A:
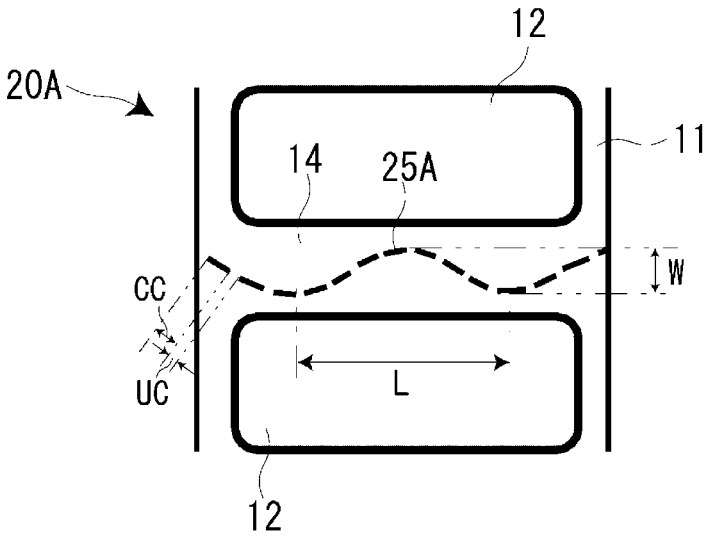
FIG. 4 is a plan view in part of roll paper for printing (specialized roll paper) according to a second embodiment of the invention.
Figure 4B:
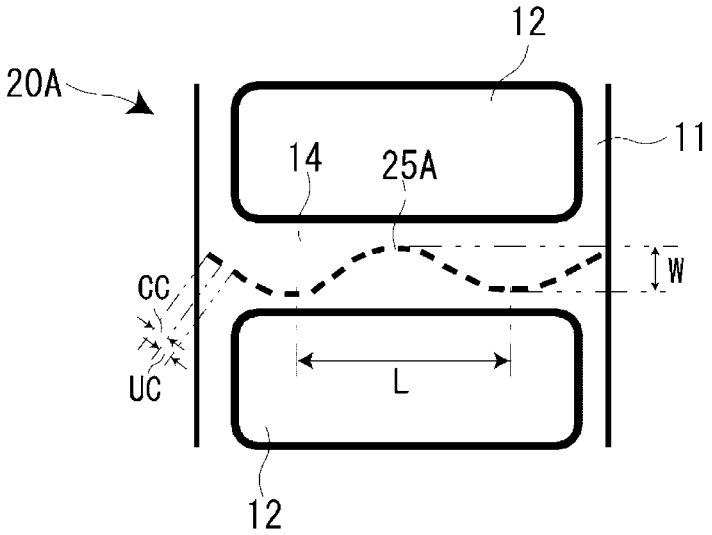

Referring next to FIG. 4, the main differences between specialized roll paper 20A according to a second embodiment of the invention and the specialized roll paper 10A of the first embodiment are described below. As shown in the figure, the perforation 25A in the specialized roll paper 20A according to the second embodiment is formed in a wave pattern across the width (crosswise to) the liner 11. More specifically, the perforations 25A are formed in a wave pattern undulating throughout the width of the formation area (space 14). The ratio between the wave height W across the width of the perforation 25A wave and the peak-to-peak distance L along the length is preferably from 1:1 to 1:5, and in this embodiment of the invention is 1:5. The ratio between the length of the cut portion CC and the length of the uncut portion UC in each perforation 25A is preferably approximately 2:1 or approximately 1:1.

The specialized roll paper 20A shown in FIG. 4 (*a*) has a perforation 25A with a 1:5 ratio between the wave height W and the peak-to-peak distance L, and a 2:1 ratio between the cut portion CC and the uncut portion UC. Below, this perforation 25A is referred to as a round perforation R.

The specialized roll paper 20A shown in FIG. 4 (*b*) has a perforation 25A with a 1:5 ratio between the wave height W and the peak-to-peak distance L, and a 1:1 ratio between the cut portion CC and the uncut portion UC. Below, this perforation 25A is referred to as a round micro-perforation RM.

Figure 5A:
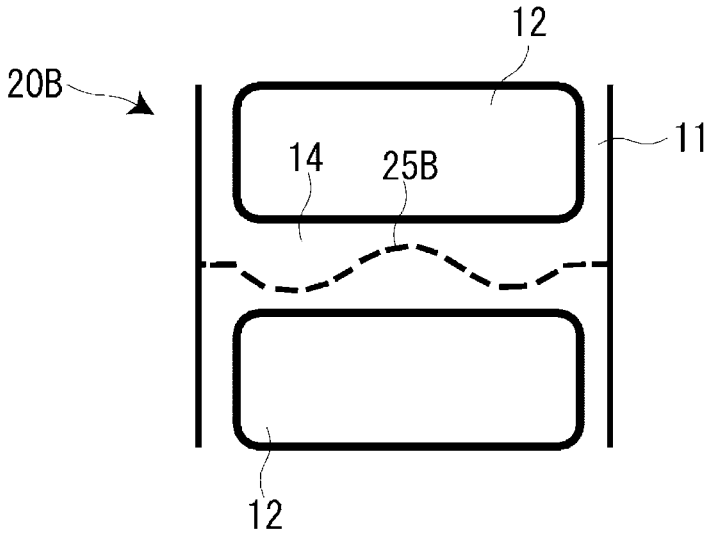
FIG. 5 is a plan view in part of roll paper for printing (specialized roll paper) according to another example of the second embodiment of the invention.
Figure 5B:
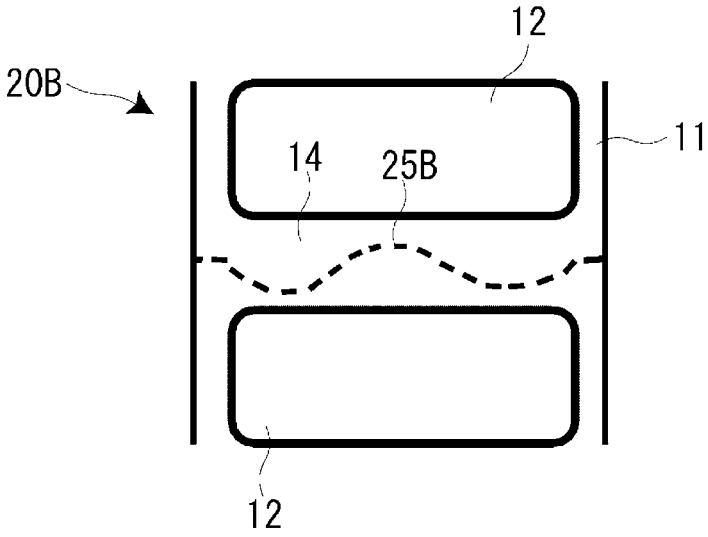

FIG. 5 illustrates specialized roll paper 20B according to another example of embodiment 2. The perforation 25B in the specialized roll paper 20B according to this example has the same basic wave shape as in the second embodiment while making tearing the perforation easier.

FIG. 5 (*a*) is a variation of the round perforation R described above with the opposite ends of the perforation continuing straight widthwise to the liner 11. More specifically, the ratio between the cut portion CC and the uncut portion UC of the perforation 25B in this variation of the round perforation R is 2:1, and the perforation 25B combines a straight cut, a wave pattern, and another straight cut across the width of the specialized roll paper 20B.

FIG. 5 (*b*) is a variation of the round micro-perforation RM described above with the opposite ends of the zigzag continuing straight widthwise to the liner 11 as described above. More specifically, the ratio between the cut portion CC and the uncut portion UC of the perforation 25B in this variation of the round micro-perforation RM is 1:1, and the perforation 25B combines a straight cut, a wave pattern, and another straight cut across the width of the specialized roll paper 20B.

Because the perforation 25A, 25B has a wave shape in the specialized roll paper 20A, 20B according to the second embodiment of the invention, the cuts CC in the perforations 25A, 25B are distributed without being aligned in the lengthwise direction of the specialized roll paper 20A, 20B. More specifically, the cuts CC are distributed throughout the entire formation area (space 24) of the wave-shaped perforations 25A, 25B. As a result, high bending resistance can be maintained in the formation area of the perforations 25A, 25B without reducing the ease of tearing the perforations 25A, 25B. Therefore, excessive separation from the suction platen 56 can be desirably prevented as described in detail below without the label paper bending at the perforations 25A, 25B (see FIG. 9 (*c*)) when the label paper is delivered from a wound roll.

Common roll paper 30 similar to the specialized roll paper 10A (10B), 20A (20B) described above is described next with reference to FIG. 6. The perforation 35 in this common roll paper 30 is formed in a straight line across the width of (crosswise to) the liner 11.

Figure 6A:
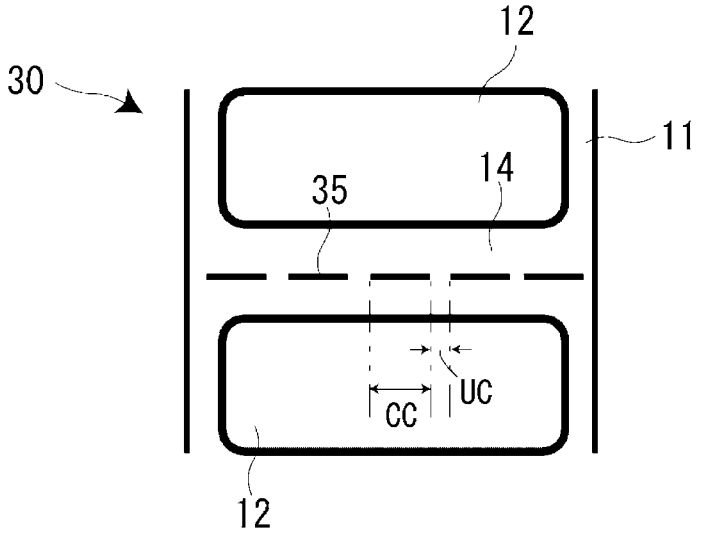
FIG. 6 is a plan view of common roll paper corresponding to the specialized roll paper.
Figure 6B:
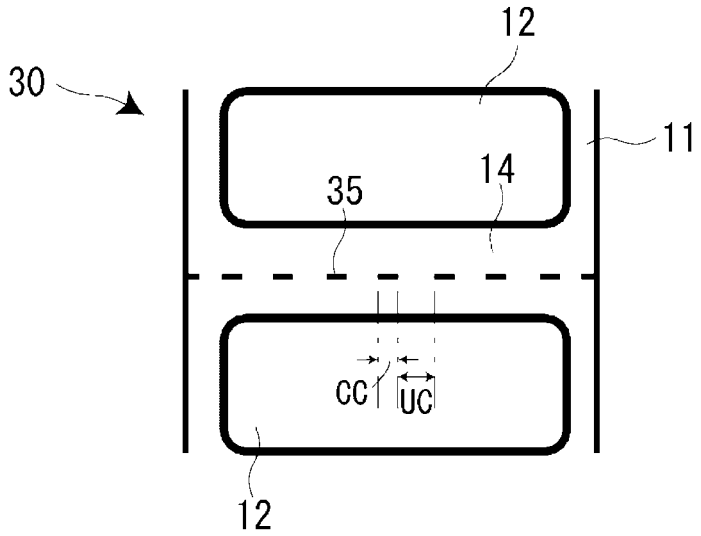

The common roll paper 30 shown in FIG. 6 (*a*) has a straight perforation 35 with a 5:1 ratio between then length of the cut portions CC and uncut portions UC, and this perforation 35 is referred to below as normal perforation N.

The common roll paper 30 shown in FIG. 6 (*b*) has a straight perforation 35 with a 0.5:1 ratio between then length of the cut portions CC and uncut portions UC, and this perforation 35 is referred to below as normal micro-perforation NM.

As described below in detail, when common roll paper 30 is unwound from the roll, the common roll paper 30 bends at the perforation 35 (see FIG. 9 (*a*)) and lifts excessively away from the suction platen 56.

An inkjet recording device 50 according to the invention is described next with reference to FIG. 7 and FIG. 8. The results of measuring the uplift from the suction platen 56 of specialized roll paper 10A, 20A having a zigzag perforation G, zigzag micro-perforation GM, round perforation R, or round micro-perforation RM, and the uplift of common roll paper 30 having a normal perforation N or normal micro-perforation NM, are also described with reference to FIG. 9 and FIG. 10. As examples of recording media, the specialized roll paper 10A, 10B, 20A, 20B and common roll paper 30 are generically referred to below as roll paper P.

Figure 7:
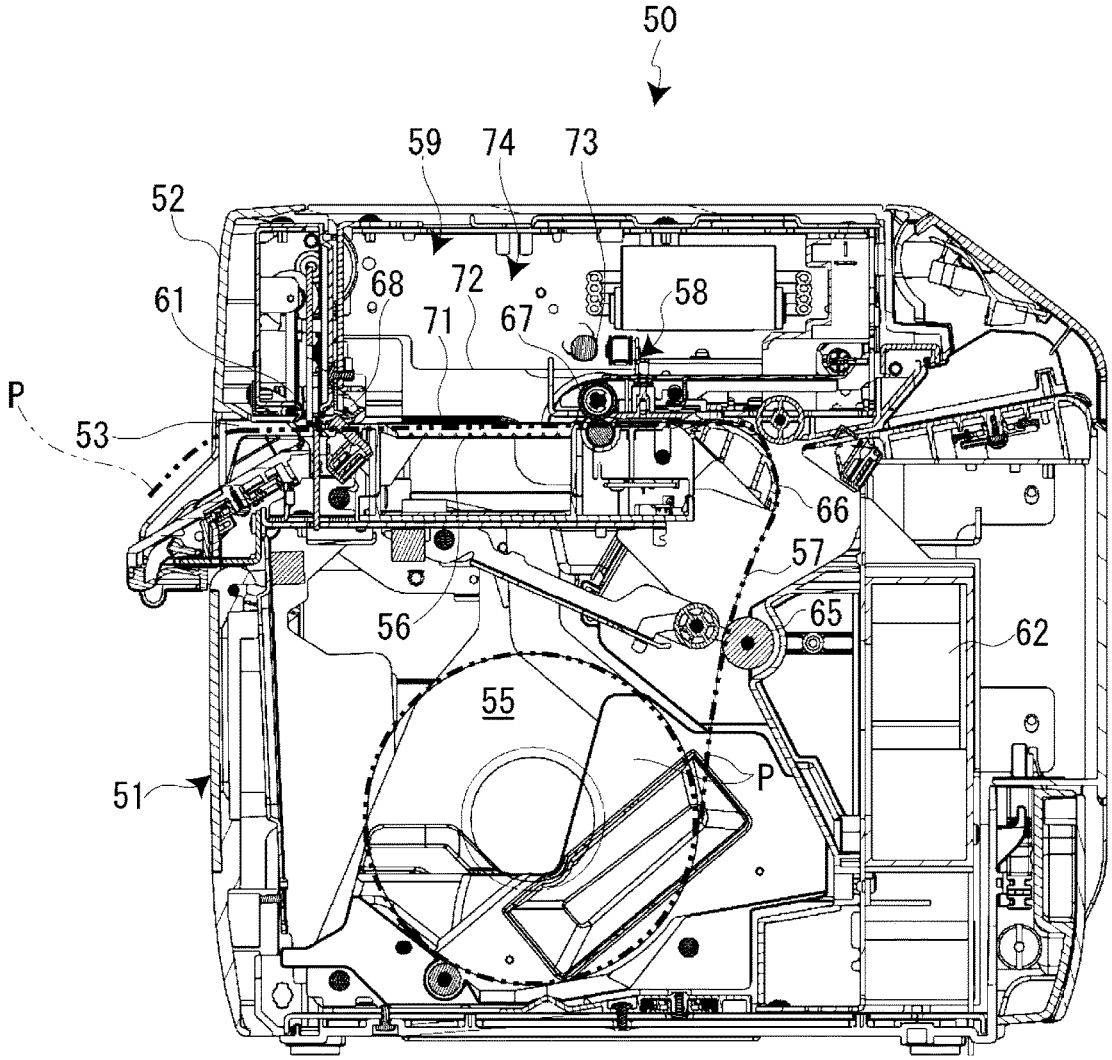
FIG. 7 illustrates the construction of an inkjet printer that uses roll paper.

As shown in FIG. 7, the inkjet recording device 50 has a basically rectangular box-like configuration with an access panel 51 for opening access to the inside of the inkjet recording device 50 is disposed to the front. A paper exit 53 is formed between the top of the access panel 51 and the printer case 52. Pulling and lowering the access panel 51 forward and open provides open access to the roll paper compartment 55, enabling replacing the roll paper P with a drop-in loading method. The suction platen 56 is also pulled forward when the access panel 51 opens, exposing the conveyance path 57 of the roll paper P.

Inside the inkjet printer 1 are the roll paper compartment 55 for storing roll paper P; a conveyance path 57 travelling up from the back of the roll paper compartment 55 and then continuing horizontally to the paper exit 53; a paper feed mechanism 58 that delivers and conveys the roll paper P through the conveyance path 57; a print mechanism 59 facing the horizontal portion of the conveyance path 57 from above; and a suction platen 56 disposed opposite the print mechanism 59 with the conveyance path 57 therebetween.

A cutter 61 that cuts the roll paper P is disposed facing the conveyance path 57 near the paper exit 53. The inkjet printer 1 also has an internal suction fan 62 at the back, and a suction duct 63 connecting the suction fan 62 and the suction platen 56 (see FIG. 8).

The paper feed mechanism 58 includes a paper feed roller 65 located diagonally behind the roll paper compartment 55; a tension guide 66 disposed where the conveyance path 57 changes direction; a conveyance roller 67 located near the upstream side of the suction platen 56; and a discharge roller 68 located near the downstream side of the suction platen 56. The paper feed roller 65, conveyance roller 67, and discharge roller 68 are nipping roller pairs including a drive roller and a driven roller.

The tension guide 66 can pivot freely vertically and is urged upward, and applies constant tension to the roll paper P between the paper feed roller 65 and the conveyance roller 67 to enable smoothly supplying the wound roll paper P from the roll paper compartment 55. The discharge roller 68 is configured to turn slightly faster than the conveyance roller 67 (slip), and apply constant tension (impart tension) to the roll paper P conveyed over the suction platen 56.

The paper feed roller 65, conveyance roller 67, and discharge roller 68 rotate synchronously, and conveyance the roll paper P through the conveyance path 57. While described in detail below, the paper feed mechanism 58 intermittently feeds (line feeds) the roll paper P synchronized to the print mechanism 59. The paper feed mechanism 58 also conveys the roll paper P continuously in response to a manual user operation to thread the roll paper P through the conveyance path after loading the roll paper P.

The print mechanism 59 includes a printhead 71, which is an inkjet head, a carriage 72 that carries the printhead 71, a guide rail 73 that supports the carriage 72 to move freely horizontally, and a moving mechanism 74 that moves the carriage 72 horizontally along the guide rail 73. Four colors of ink, Y, M, C, B, are supplied from ink cartridges not shown to the printhead 71, which selectively ejects the four colors of ink to print in color.

While not shown in the figures, the moving mechanism 74 includes a timing belt mounted on a drive pulley and a driven pulley, and a carriage motor that moves the timing belt forward and reverse by the intervening drive pulley. The carriage 72 is attached to one part of the timing belt, and the printhead 71 mounted on the carriage 72 moves horizontally by driving the carriage motor forward or reverse.

More specifically, by moving the printhead 71 on outbound and return trips horizontally with the moving mechanism 74 while driving the printhead 71 to selectively eject the four colors of ink, the inkjet printer 1 prints (in the primary scanning direction) and advances the roll paper P in the line feed direction (secondary scanning direction) between the outbound and return trips by means of the paper feed mechanism 58. As a result, the roll paper P is printed in color. When color printing is completed and the print medium is further advanced a margin distance, conveyance of the roll paper P stops, the cutter 61 operates, and the printed portion of the roll paper P is cut off (discharged). When the roll paper P of this embodiment is roll paper P with a perforation 15A, 25A 30, the operating mode may be changed to not use the automatic cutter.

Figure 8:
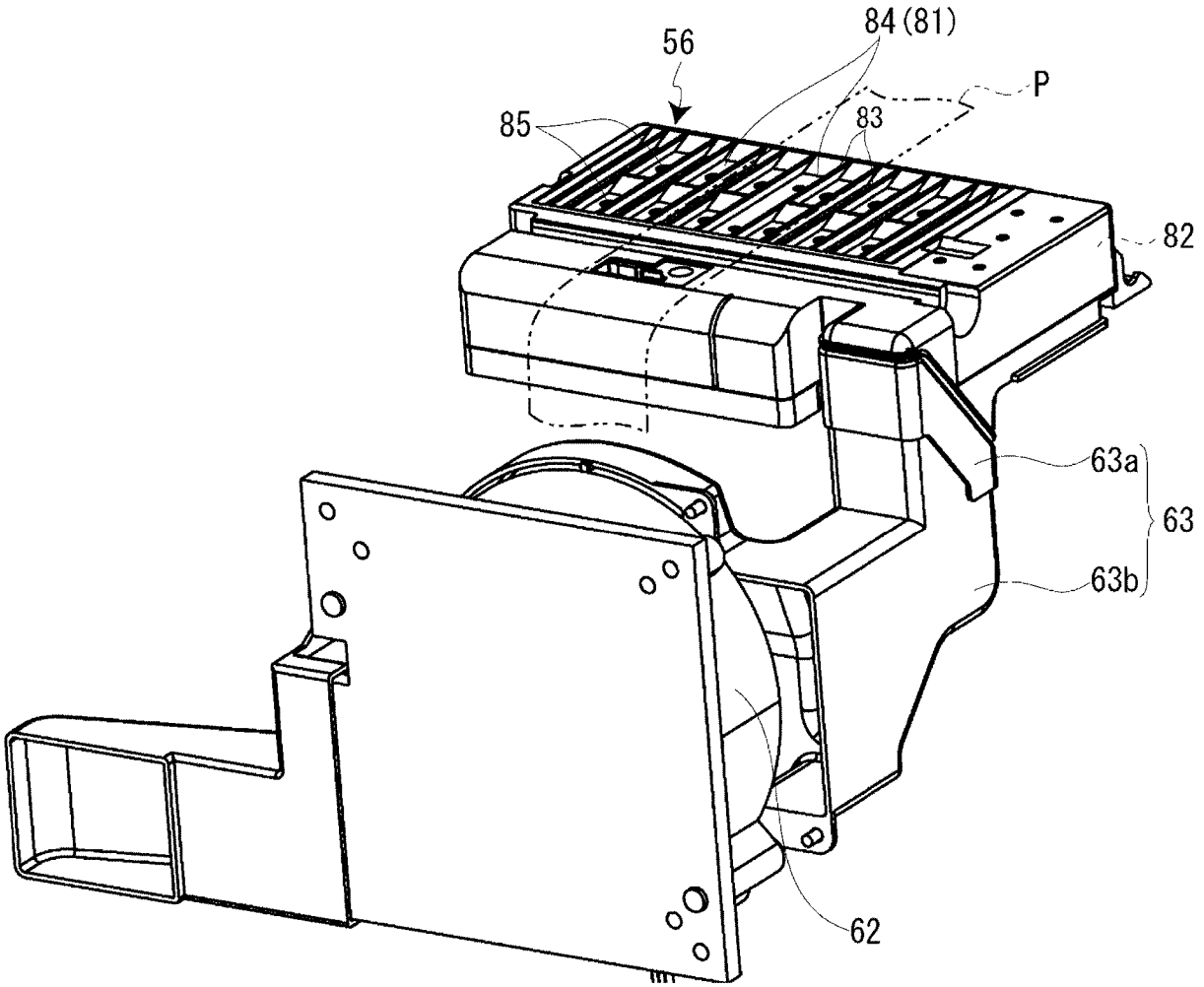
FIG. 8 illustrates the area around the suction platen of the inkjet printer.

As shown in FIG. 7 and FIG. 8, the suction platen 56 is connected to the suction fan 62 through the suction duct 63. Because the suction platen 56 moves in conjunction with opening and closing the access panel 51, the suction duct 63 includes a platen-side duct 63*a* on the side of the suction platen 56, and a fan-side duct 63*b* on the suction fan 62 side, that are configured to connect and disconnect freely.

The suction fan 62 operates synchronized to the power turning on, and produces a suction force through the suction platen 56 on the roll paper P conveyed by the paper feed mechanism 58. During the actual printing operation when the roll paper P is conveyed intermittently, the suction platen 56 holds the roll paper P when the roll paper P is stopped, and applies suction (a force of attraction) when the roll paper P is conveyed. As a result, the roll paper P is held flat on the suction platen 56, and a desirable paper gap is maintained between the roll paper P and the printhead 71.

As shown in FIG. 8, the suction platen 56 has a large suction area 81 on the surface, an internal suction chamber 82 that communicates with the suction area 81, and is generally shaped like a box. The platen-side duct 63*a* is connected at the left inside part of the suction platen 56, and the suction chamber 82 communicates with the suction fan 62 through the platen-side duct 63*a* and the fan-side duct 63*b*.

The suction area 81 is divided into plural individual suction areas 84 by a plurality of guide ribs 83. An intake port 85 is disposed appropriately to each of the individual suction areas 84. These intake ports 85 communicate with the suction chamber 82, and by driving the suction fan 62, the roll paper P is suctioned by the individual suction area 84 units. When the roll paper P is conveyed centered on the platen, narrow roll paper P is held mainly by the plural individual suction areas 84 in the middle, and wide roll paper P is held by plural individual suction areas 84 across the entire platen.

The behavior of the specialized roll paper 10A, 20A and common roll paper 30 as examples of roll paper P when unrolled and free is described with reference to FIG. 9. The results of measuring the uplift from the suction platen 56 of the specialized roll paper 10A, 20A and common roll paper 30 are also described with reference to FIG. 10.

Figure 9A:
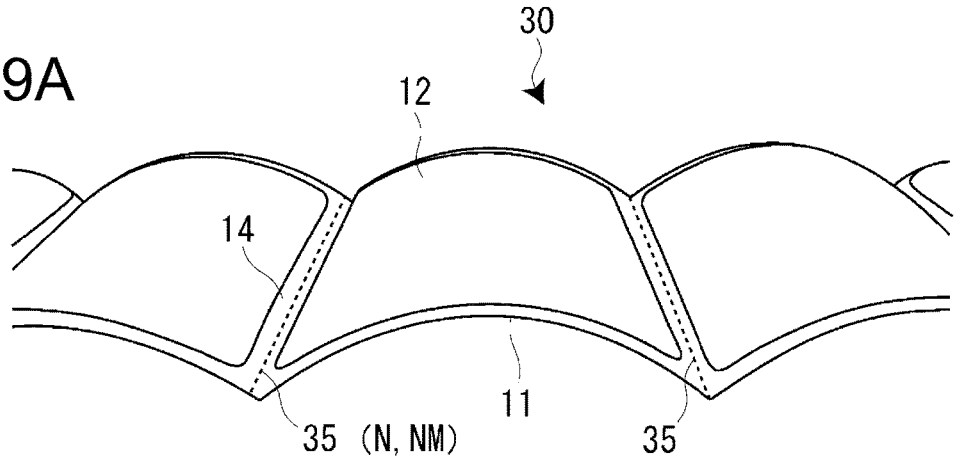
FIG. 9 shows the specialized roll paper and common roll paper when unwound.
Figure 9B:
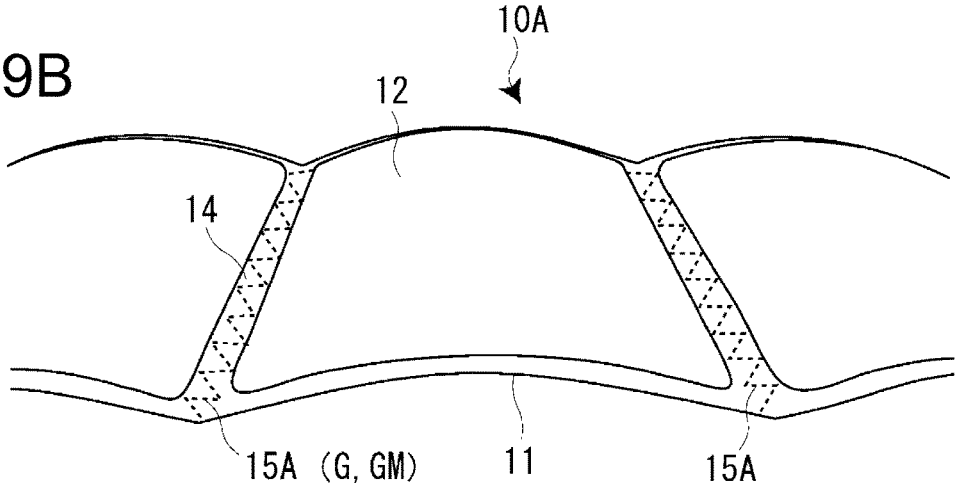
Figure 9C:
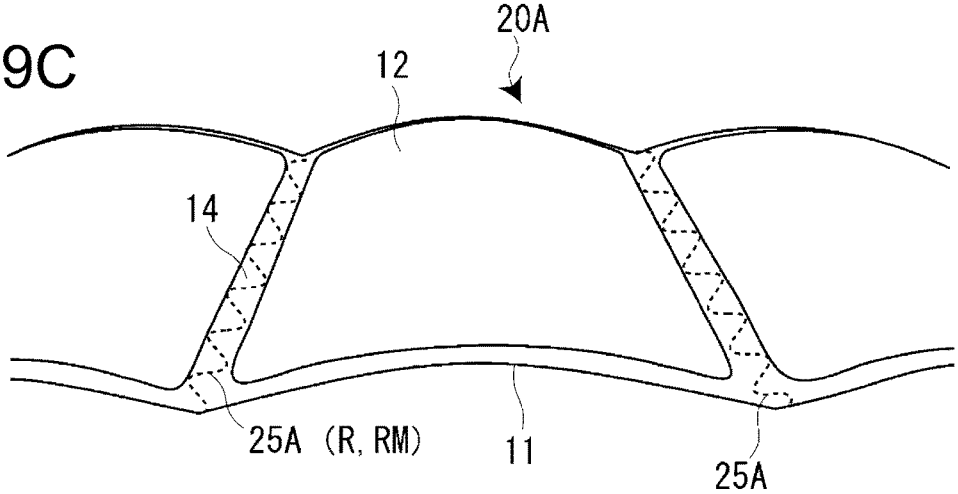

FIG. 9 shows the common roll paper 30, specialized roll paper 10A, and specialized roll paper 20A when unrolled from the paper roll. More specifically, FIG. 9 shows the end of the common roll paper 30, specialized roll paper 10A, and specialized roll paper 20A at the end near the core where the paper is tightly curled.

The common roll paper 30 shown in FIG. 9 (*a*) is formed with a normal N (or normal micro-perforation NM) perforation 35, and when unrolled bends at the perforation 35. More specifically, the label 12 portion of the paper arches greatly because of the curl in the paper, and the perforation 35 bends into a deep valley because of the extremely low bending resistance. The height (the uplift when unrolled) of the arch in the common roll paper 30 resulting from the tight curl in this example was 7.0 mm.

The specialized roll paper 10A shown in FIG. 9 (*b*) is formed with a zigzag G (or micro-zigzag GM) perforation 15A, and when unrolled curves at the perforation 15A. More specifically, the label 12 portion of the paper curves because of the curl in the paper, and the perforation 15A curves through a shallow depression because the bending resistance of the liner 11 is maintained. The uplift of the specialized roll paper 10A in this example when unrolled was 3.5 mm.

The specialized roll paper 20A shown in FIG. 9 (*c*) is formed with a round R (or round micro-perforation RM) perforation 25A, and when unrolled curves at the perforation 25A. More specifically, the label 12 portion of the paper curves because of the curl in the paper, and the perforation 25A curves through a shallow depression because the bending resistance of the liner 11 is maintained. The uplift of the specialized roll paper 20A in this example when unrolled was 3.5 mm.

Note that while not shown in the figure, the uplift of the same type of roll paper P (label paper) without perforations was 3.0 mm when unrolled. This demonstrates the extremely low drop in bending resistance caused by the perforations 15A, 25A in the specialized roll paper 10A, 20A.

Figure 10:
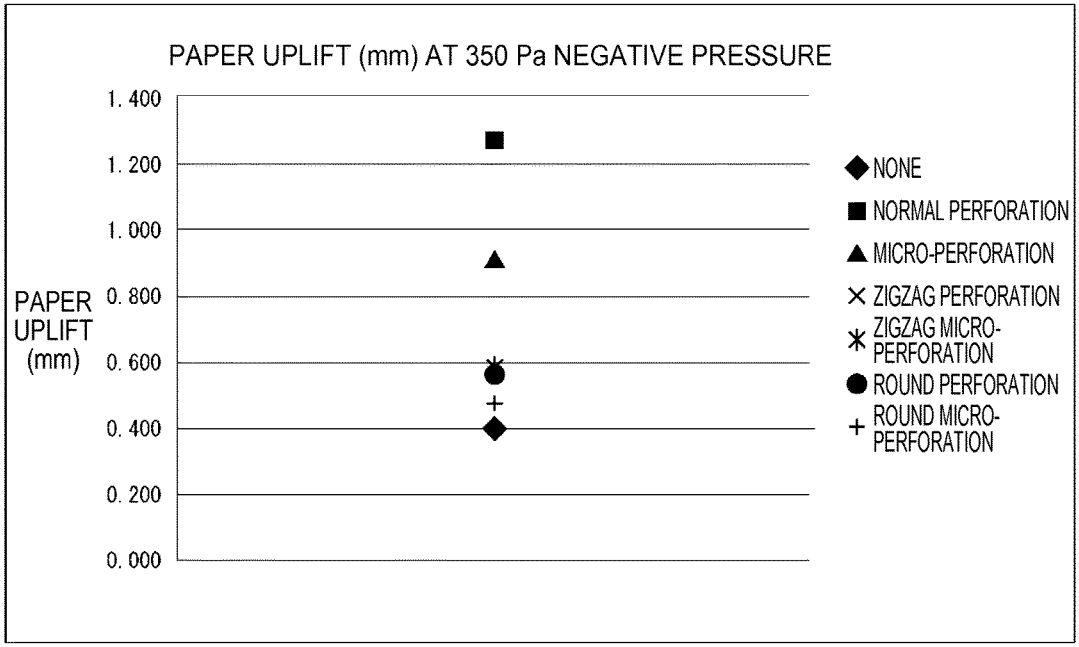
FIG. 10 shows the results of measuring the uplift of roll paper on the suction platen.

FIG. 10 shows the results of measuring the uplift from the suction platen 56 in specialized roll paper 10A, 20A and in common roll paper 30. The uplift from the suction platen 56 was measured for specialized roll paper 10A with a zigzag perforation G and with a zigzag micro-perforation GM, specialized roll paper 20A with a round perforation R and with a round micro-perforation RM, and common roll paper 30 with a normal perforation N and with a normal micro-perforation NM while applying suction (negative pressure: 350 Pa) from the suction platen 56.

As shown in the figure, the uplift in common roll paper 30 with the normal perforation N was slightly greater than 1.2 mm, and the uplift was 0.9 mm in common roll paper 30 with a normal micro-perforation NM having short cuts CC. The paper uplift is preferably 0.6 mm or less in the inkjet recording device 50 according to this embodiment to maintain desirable print quality. Print quality can therefore not be assured when using common roll paper 30.

The uplift in specialized roll paper 10A with a zigzag perforation G was slightly less than 0.6 mm, and the uplift in specialized roll paper 10A with a zigzag micro-perforation GM was also slightly less than 0.6 mm.

The uplift in specialized roll paper 20A with a round perforation R was also slightly less than 0.6 mm, and the uplift in specialized roll paper 20A with a round micro-perforation RM having short cuts CC was slightly less than 0.4 mm.

Comparing specialized roll paper 10A and the specialized roll paper 20A confirmed that forming extremely few cuts CC crosswise and making the cuts CC short in the perforations 15A, 25A affects the paper uplift (bending resistance). In both examples, however, the uplift was 0.6 mm or less, and print quality can be assured.

As described above, using specialized roll paper 10A, 20A with a sawtooth or wave-shaped perforation 15A, 25A can suppress paper uplift and can maintain good print quality.

Paper uplift can obviously also be suppressed (to 0.6 mm or less) and good print quality can be maintained using common roll paper 30 with a straight perforation 35 by increasing the suction force.

Figure 11:
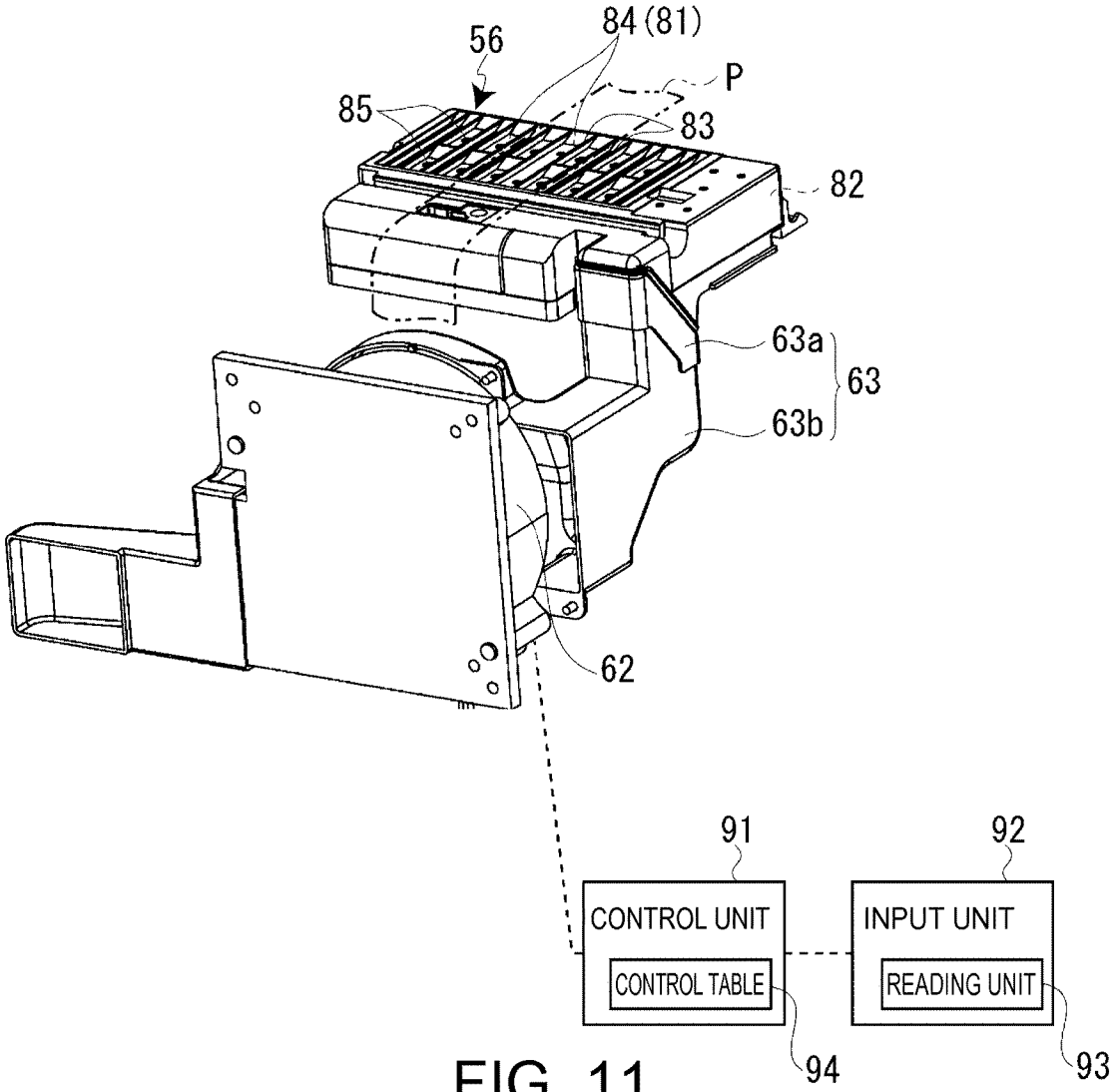
FIG. 11 illustrates the area around the suction platen of an inkjet printer according to a second embodiment of the invention.

FIG. 11 illustrates an inkjet recording device 50 according to a second embodiment of the invention configured to change the suction force of the suction platen 56 according to whether the roll paper P used in the inkjet recording device 50 is specialized roll paper 10A, 20A or common roll paper 30.

As shown in the figure, the suction fan 62 is connected to a control unit 91, the control unit 91 is connected to an input unit 92, and the control unit 91 controls (inverter control) the speed of the suction fan 62 based on information input from the input unit 92. The input unit 92 has a reading unit 93 that reads RFID tags, barcodes, 2D symbols, and black index marks on the loaded roll paper P, and outputs the type of roll paper P that is read to the control unit 91. The control unit 91 has a control table 94 that defines the relationship between the type of roll paper P and the speed of the suction fan 62, and controls the speed (rotational speed) of the suction fan 62 based on the type of roll paper P.

For example, the speed of the suction fan 62 is set to 5000 rpm if the roll paper P is specialized roll paper 10A, 20A, and the speed of the suction fan 62 is set to 6000 rpm if the roll paper P is common roll paper 30. By thus controlling the suction force of the suction platen 56 through the suction fan 62, both specialized roll paper 10A, 20A and common roll paper 30 can be appropriately held to the platen. As a result, stable print quality can be maintained. Note that the type of roll paper P may be input manually to the input unit 92, or an input unit may be disposed to a computer to which the inkjet recording device 50 connects and input therefrom. To control the suction fan 62 appropriately, the control table 94 also preferably includes other types of roll paper P.

Parameters such as the thickness and the material of the roll paper P may also be included for each type of roll paper P, and the speed (rotational speed) of the suction fan 62 controlled based also on these additional parameters.

Note that the above embodiments describe examples having a suction platen, but the invention can also be applied to devices that hold roll paper to the platen by disposing an electrostatic attraction mechanism to the platen.

REFERENCE SIGNS LIST

10A specialized roll paper (roll paper for printing)
10B specialized roll paper
11 liner
12 label
13 adhesive
15A perforation
15B perforation
20A specialized roll paper
20B specialized roll paper
25A perforation
25B perforation
30 common roll paper
35 perforation
50 inkjet recording device
56 suction platen
58 paper feed mechanism
59 print mechanism
62 suction fan
71 printhead
97 control unit
P roll paper
W displacement width
L peak-to-peak distance
CC cut
UC uncut portion

The invention claimed is:

1. An inkjet recording device comprising:

a conveyance roller configured to convey at least one of common roll paper having straight perforations formed across a width of the common roll paper or specialized roll paper having a plurality of perforations of a shape different from the perforations in the common roll paper;

a printhead configured to selectively eject ink and print on the specialized roll paper and the common roll paper;

a suction platen that is disposed opposite the printhead and is configured to apply suction force to the conveyed specialized roll paper and common roll paper;

a suction fan configured to communicate with the suction platen; and a control unit configured to control driving of the suction fan based on a perforation type of the roll paper using a control table that specifies a different respective suction force for each of the specialized roll paper having a plurality of perforations of a shape different from the perforations in the common roll paper, and the common roll paper having straight perforations formed across a width of the common roll paper.

2. The inkjet recording device described in claim 1, wherein:

the inkjet recording device has a reading unit configured to read the type of specialized roll paper and common roll paper, thickness information for the specialized roll paper and the common roll paper is included for each type, and the control unit is configured to control driving of the suction fan according to the thickness.

3. The inkjet recording device described in claim 2, wherein:

information about the material of the specialized roll paper and the common roll paper is included for each type, and the control unit is configured to control driving of the suction fan according to the material.

4. The inkjet recording device of claim 2, further comprising:

a suction duct connecting the suction fan to the suction platen.

5. The inkjet recording device of claim 4, wherein the suction duct comprises a first duct and a second duct configured to selectively connect or disconnect.

* * * * *